United States Patent [19]

Harrison et al.

[11] Patent Number: 4,734,397

[45] Date of Patent: Mar. 29, 1988

[54] COMPRESSION LAYER FOR DYE-RECEIVING ELEMENT USED IN THERMAL DYE TRANSFER

[75] Inventors: Daniel J. Harrison, Rochester; Kin K. Lum, Webster; Noel R. Vanier, Rochester, all of N.Y.

[73] Assignee: Eastman Kodak Company, Rochester, N.Y.

[21] Appl. No.: 76,432

[22] Filed: Jul. 21, 1987

Related U.S. Application Data

[63] Continuation-in-part of Ser. No. 916,927, Oct. 8, 1986.

[51] Int. Cl.[4] ..... B41M 5/26

[52] U.S. Cl. ..... 503/227; 8/471; 428/195; 428/480; 428/483; 428/500; 428/522; 428/523; 428/913; 428/914; 430/945

[58] Field of Search ..... 8/470, 471; 428/195, 428/207, 480, 483, 500, 522, 523, 913, 914; 430/945; 503/227

[56] References Cited

FOREIGN PATENT DOCUMENTS

| | | | |
|---|---|---|---|
| 194106 | 6/1984 | European Pat. Off. | 503/227 |
| 60/236794 | 4/1984 | Japan | 503/227 |

*Primary Examiner*—Bruce H. Hess
*Attorney, Agent, or Firm*—Harold E. Cole

[57] ABSTRACT

A dye-receiving element for thermal dye transfer process and assemblage comprises a compression layer between a film support and the dye image-receiving layer which has a greater compressibility than either the support or the receiving layer, is coated at a coverage of at least 2.0 g/m$^2$, and has an elasticity of less than 500% elongation at break. In a preferred embodiment, the compression layer has a compression modulus of less than 350 mega Pascals. Use of the compression layer minimizes image defects while providing good scratch resistance.

20 Claims, No Drawings

COMPRESSION LAYER FOR DYE-RECEIVING ELEMENT USED IN THERMAL DYE TRANSFER

This is a continuation-in-part of application Ser. No. 916,927, filed Oct. 8, 1986.

This invention relates to dye-receiving elements used in thermal dye transfer, and more particularly to the use of a compression layer between a film support and the dye image-receiving layer, in order to minimize image defects while providing good scratch resistance.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head thus has many heating elements and is heated up sequentially in response to the cyan, magenta and yellow signals. The process is then repeated for the other two colors. A color hard copy is thus obtained which corresponds to the original picture viewed on a screen. Further details of this process and an apparatus for carrying it out are contained in U.S. Pat. No. 4,621,271 by Brownstein entitled "Apparatus and Method For Controlling A Thermal Printer Apparatus," issued Nov. 4, 1986, the disclosure of which is hereby incorporated by reference.

There are problems with the above-described process in that nonuniformity of the thickness of the image-receiving layer of the dye-receiving element causes the production of irregular images. In addition, defects in a thermal print element may be caused by entrapped dust and irregularities in the thermal head, printing platten, dye-donor element and dye-receiving element. These defects generally show up as non-printed (i.e., minimum density) spots and areas, and thus are very visible against higher density backgrounds.

In European Patent Application No. 194,106, a receptive sheet is disclosed which has an intermediate layer between the base sheet and the receptive layer. The intermediate layer has a 100% modulus of 100 kg/cm$^2$ or lower as defined under JIS-K-6301.

There is a problem with the above intermediate layer in that it degrades the scratch resistance of the dye-receiving layer. A dye-receiver without good scratch resistance will scratch easily and cause the print quality to deteriorate. As will be shown by comparative tests hereinafter, the dye-receiving elements of the invention have a much better scratch resistance than the dye-receiving elements of the prior art.

It would be desirable to provide a thermal print element with less defects and good scratch resistance.

These and other objects are achieved in accordance with this invention which comprises a dye-receiving element for thermal dye transfer comprising a film support having thereon, in order, a compression layer and a dye image-receiving layer, the compression layer having a compressibility greater than that of the support or the dye image-receiving layer, the compression layer being coated at a coverage of at least 2.0 g/m$^2$, and the compression layer having an elasticity of less than 500% elongation at break. Use of this layer of the invention promotes better printing contact between the dye-donor and dye image-receiving element, thus reducing the number of defects, and also enables the dye-receiving layer to have good scratch resistance.

In a preferred embodiment of the invention, the compression layer has a compression modulus of less than 350 mega Pascals ($10^6$ Pascals) (MPa).

The following list of preferred polymeric materials have a compression modulus of less than 350 MPa and an elasticity of less than 500% elongation at break:

Compound 1—poly(methylmethacrylate)

Compound 2—poly(styrene-co-acrylonitrile) (70:30 weight ratio)

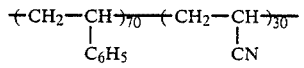

Compound 3—poly(butylene terephthalate) modified with 30 mol % glutaric acid and 45 mol % diethylene glycol Compound 4—a lightly branched ether modified poly(cyclohexylene-cyclohexane-dicarboxylate):

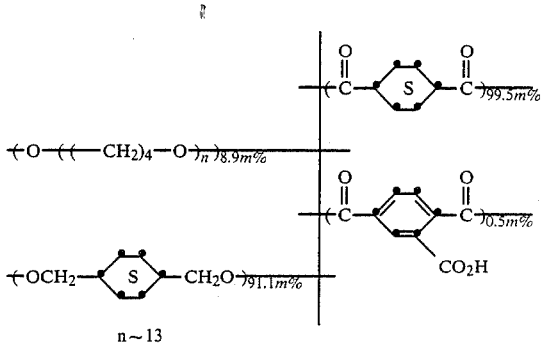

Compound 5—poly(styrene)

Compound 6—poly(caprolactone)

Compound 7—Petrarch MB (PS254)® (Petrarch Systems Inc.) described by the supplier as a "fully cured thermoplastic silicone copolymer dissolved in a chlorinated solvent".

Compound 8—polyurethane (Nippolan 5109®) (Nippon Polyurethane, Japan)

Compound 9—High-density polyethylene

Compound 10—Poly(n-butyl acrylate-co-acrylic acid (wt ratio 60:40)

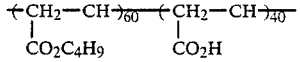

Compound 11—Same as 10 but with wt. ratio 50:50

Compound 12—Same as 10 but with wt. ratio 30:70

The film support for the dye-receiving element of the invention may be a transparent film such as a poly(ether sulfone), a polyimide, a cellulose ester such as cellulose acetate, a poly(vinyl alcohol-co-acetal) or a poly(ethylene terephthalate). The film support for the dye-receiving element may also be reflective such as white polyester (polyester with white pigment incorporated therein). In a preferred embodiment, polyester with a white pigment incorporated therein is employed.

The dye image-receiving layer may comprise, for example, a polycarbonate, a polyester or mixtures thereof. The dye image-receiving layer may be present in an amount which is effective for the intended purpose. In general, good results have been obtained at a concentration of from about 1 to about 5 g/m$^2$.

A dye-donor element that is used with the dye-receiving element of the invention comprises a support having thereon a dye layer. Any dye can be used in such a layer provided it is transferable to the dye image-receiving layer of the dye-receiving element of the invention by the action of heat. Especially good results have been obtained with sublimable dyes. Examples of sublimable dyes include anthraquinone dyes, e.g., Sumikalon Violet RS ® (product of Sumitomo Chemical Co., Ltd.), Dianix Fast Violet 3R-FS ® (product of Mitsubishi Chemical Industries, Ltd.), and Kayalon Polyol Brilliant Blue N-BGM ® and KST Black 146 ® (products of Nippon Kayaku Co., Ltd.); azo dyes such as Kayalon Polyol Brilliant Blue BM ®, Kayalon Polyol Dark Blue 2BM ®, and KST Black KR ® (products of Nippon Kayaku Co., Ltd.), Sumickaron Diazo Black 5G ® (product of Sumitomo Chemical Co., Ltd.), and Miktazol Black 5GH ® (product of Mitsui Toatsu Chemicals, Inc.); direct dyes such as Direct Dark Green B ® (product of Mitsubishi Chemical Industries, Ltd.) and Direct Brown M ® and Direct Fast Black D ® (products of Nippon Kayaku Co. Ltd.); acid dyes such as Kayanol Milling Cyanine 5R ® (product of Nippon Kayaku Co. Ltd.); basic dyes such as Sumicacryl Blue 6G ® (product of Sumitomo Chemical Co., Ltd.), and Aizen Malachite Green ® (product of Hodogaya Chemical Co., Ltd.);

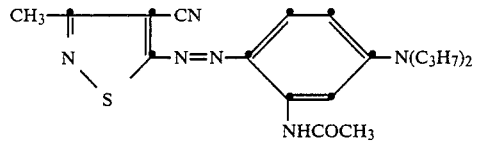

(magenta)

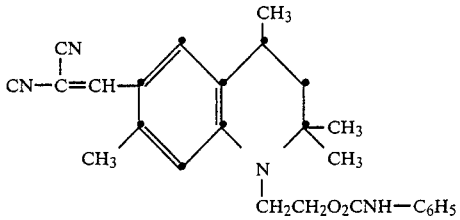

(yellow)

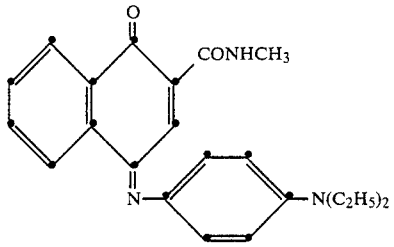

(cyan)

or any of the dyes disclosed in U.S. Pat. No. 4,541,830, the disclosure of which is hereby incorporated by reference. The above dyes may be employed singly or in combination to obtain a monochrome. The dyes may be used at a coverage of from about 0.05 to about 1 g/m$^2$ and are preferably hydrophobic.

The dye in the dye-donor element is dispersed in a polymeric binder such as a cellulose derivative, e.g., cellulose acetate hydrogen phthalate, cellulose acetate, cellulose acetate propionate, cellulose acetate butyrate, cellulose triacetate; a polycarbonate; poly(styrene-co-acrylonitrile), a poly(sulfone) or a poly(phenylene oxide). The binder may be used at a coverage of from about 0.1 to about 5 g/m$^2$.

The dye layer of the dye-donor element may be coated on the support or printed thereon by a printing technique such as a gravure process.

Any material can be used as the support for the dye-donor element provided it is dimensionally stable and can withstand the heat of the thermal printing heads. Such materials include polyesters such as poly(ethylene terephthalate); polyamides; polycarbonates; glassine paper; condenser paper; cellulose esters such as cellulose acetate; fluorine polymers such as polyvinylidene fluoride or poly(tetrafluoroethylene-co-hexafluoropropylene); polyethers such as polyoxymethylene; polyacetals; polyolefins such as polystyrene, polyethylene, polypropylene or methylpentane polymers; and polyimides such as polyimide-amides and polyether imides. The support generally has a thickness of from about 2 to about 30 μm. It may also be coated with a subbing layer, if desired.

A dye-barrier layer comprising a hydrophilic polymer may also be employed in the dye-donor element between its support and the dye layer which provides improved dye transfer densities.

The reverse side of the dye-donor element may be coated with a slipping layer to prevent the printing head from sticking to the dye-donor element. Such a slipping layer would comprise a lubricating material such as a surface active agent, a liquid lubricant, a solid lubricant or mixtures thereof, with or without a polymeric binder. Preferred lubricating materials include oils or semi-crystalline organic solids that melt below 100° C. such as poly(vinyl stearate), beeswax, perfluorinated alkyl ester polyethers, poly(caprolactone), carbowax or poly(ethylene glycols). Suitable polymeric binders for the slipping layer include poly(vinyl alcohol-co-butyral), poly(vinyl alcohol-co-acetal), poly(styrene), poly(vinyl acetate), cellulose acetate butyrate, cellulose acetate, or ethyl cellulose.

The amount of the lubricating material to be used in the slipping layer depends largely on the type of lubricating material, but is generally in the range of about 0.001 to about 2 g/m$^2$. If a polymeric binder is employed, the lubricating material is present in the range of 0.1 to 50 weight %, preferably 0.5 to 40, of the polymeric binder employed.

As noted above, dye-donor elements are used to form a dye transfer image. Such a process comprises image-wise-heating a dye-donor element and transferring a dye image to a dye-receiving element as described above to form the dye transfer image. An additional step of heating the dye-receiving element containing the transferred dye image will reduce stratification of the transferred image dye in the dye-receiving element. This can be done using a separate heated roller or heating apparatus, or the thermal print head itself can be used in the heating step as disclosed and claimed in copending U.S. Application Ser. No. 879,690 filed June 27, 1986, by Vanier et al. entitled "Non-imagewise Reheating of Transferred Dyes in Thermal Dye Transfer Elements."

The dye-donor element employed in certain embodiments of the invention may be used in sheet form or in a continuous roll or ribbon. If a continuous roll or ribbon is employed, it may have only one dye thereon or may have alternating areas of different dyes, such as cyan, magenta, yellow, black, etc., as disclosed in U.S. Pat. No. 4,451,830.

In a preferred embodiment of the invention, a dye-donor element is employed which comprises a poly(ethylene terephthalate) support coated with sequential repeating areas of cyan, magenta and yellow dye, and the above process steps are sequentially performed for each color to obtain a three-color dye transfer image. Of course, when the process is only performed for a single color, then a monochrome dye transfer image is obtained.

Thermal printing heads which can be used to transfer dye from the dye-donor elements employed in the invention are available commercially. There can be employed, for example, a Fujitsu Thermal Head (FTP-040 MCSOO1), a TDK Thermal Head F415 HH7-1089 or a Rohm Thermal Head KE 2008-F3.

A thermal dye transfer assemblage of the invention comprises (a) a dye-donor element as described above, and (b) a dye-receiving element as described above, the dye-receiving element being in a superposed relationship with the dye-donor element so that the dye layer of the donor element is in contact with the dye image-receiving layer of the receiving element.

The above assemblage comprising these two elements may be preassembled as an integral unit when a monochrome image is to be obtained. This may be done by temporarily adhering the two elements together at their margins. After transfer, the dye-receiving element is then peeled apart to reveal the dye transfering image.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought in register with the dye-receiving element and the process repeated. The third color is obtained in the same manner.

The following examples are provided to illustrate the invention.

EXAMPLE 1

Compressibility and Dirt Tests

A magenta dye-donor element was prepared by coating the following layers in the order recited on a 6 μm poly(ethylene terephthalate) support:

(1) Dye barrier layer of poly(acrylic acid) (0.17 g/m$^2$) coated from a water-methanol solvent mixture; and (2) Dye layer containing the following magenta dye (0.22 g/m$^2$) in a cellulose acetate hydrogen phthalate (32–36% phthalyl) (18–21% acetyl) binder (0.38 g/m$^2$) coated from an acetone, butanone and cyclohexanone solvent mixture:

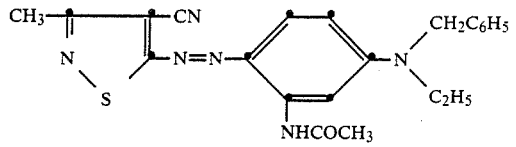

A slipping layer was coated on the back side of the element similar to that disclosed in U.S. Application Ser. No. 925,949 of Vanier et al. filed Nov. 3, 1986.

Dye-receiving elements according to the invention were prepared by coating on a poly(ethylene terephthalate) support containing titanium dioxide of 175 um (7 mil) thickness:

(1) a compression layer as indicated in Table 1 from a dichloromethane and trichloroethylene solvent mixture, and (2) a dye image-receiving layer of a solution of Bayer AG Makrolon 5705® Polycarbonate (2.9 g/m$^2$), 1,4-didecoxy-2,5-dimethoxybenzene (0.38 g/m$^2$) and FC-431® surfactant (3M Corp) (0.017 g/m$^2$) coated from a dichloromethane and trichloroethylene solvent mixture.

Additional dye-receiving elements were prepared according to the invention similar to those described above except that the dye image-receiving layer was hot-melt laminated onto the compression layer. This was accomplished by first coating the dye-image receiving layer onto an unsubbed poly(ethylene terephthalate) (7 mil) film support. The receiving layer side of this coating was then placed in contact with the compresson layer coated on the white support. This composite was then laminated together with a pair of rubber rollers heated to about 150° C. After cooling, the unsubbed film support was peeled away from the composite leaving the receiving layer laminated to the compression layer.

A control receiving element, C1, was prepared by coating the above dye image-receiving layer directly on the white polyester support.

Another control receiving element, C2, was prepared by coating an interlayer of a "rigid" (i.e., relatively non-compressible) polymer of Lexan 131® bisphenol-A polycarbonate, General Electric Corp., at 5.4 g/m$^2$ on top of the white polyester support. This was then coated with the dye image-receiving layer 2 above.

Another control receiving element, C3, was the white polyester support only.

Dirt Test Because casual dirt, as encountered in various indoor environments cannot be easily reproduced, a "dirt" test had to be devised. This basically consisted of introducing a fixed level of material simulating dirt onto the surface of a dye-donor, thermally printing the donor onto the receiver, and then visually counting the number of defects observed above a given size on the dye-receiver surface. The material chosen to simulate dirt was Teflon® beads.

A Paasche Airbrush® (with H5 and HC5 color and air parts) was used to spray duPont Teflon 35® Resin Fluorocarbon Dispersion (a 32% solids solution of 0.05 to 0.5 μm diameter Teflon® particles). The dye side of the dye-donor was sprayed until a visually uniform "stipple" effect was produced. The treated donor was then allowed to air dry for a few minutes.

The dye side of the treated dye-donor element strip 4.5 inches (114 mm) wide was then placed in contact with the dye image-receiving layer of the dye-receiver element of the same width. The assemblage was fastened in the jaws of a stepper motor driven pulling device. The assemblage was laid on top of a 0.55 in. (14 mm) diameter hard rubber roller and a Kyocera Thermal Head, Type KMT-85-6NPDI, was pressed with weights of a force of 9.0 pounds (4.0 kg) against the dye-donor element side of the assemblage pushing it against the rubber roller.

The imaging electronics were activated causing the pulling device to draw the assemblage between the printing head and roller at 0.123 inches/sec (3.1 mm/sec). Coincidentally, the resistive elements in the thermal print head were pulse-heated at increments from 0 to 8.3 msec to generate a mid-scale uniform density test image approximately 8 cm×10 cm (of 512 pixels in 512 lines). The voltage supplied to the print head was approximately 22 v representing approximately 1.5 watts/dot (12 mjoules/dot) for maximum power.

Each dye-receiver was separated from each dye donor and the latter was examined for surface defects or "dirt". The number of low density (or non-printed) spots equal or greater in size than 0.2 mm diameter within a 1 cm by 1 cm area were determined. This process was repeated for another two areas on each dye donor to obtain an "average spots/cm$^2$" (s/cm$^2$).

Compressibility Test A compressibility test involving surface deformation with a tool-steel pin was also run. Each compression layer or control interlayer was compression molded or solvent cast and dried as a separate film, 75 μm to 100 μm thick. The compression modulus in mega Pascals was determined using an Instron® Model 1133 Tensile Testing Machine with a compression cage and tool-steel pin 0.3275 cm long and 0.05 cm diameter normal to the film. The speed of compresson was 0.1 cm/min and the compressive strain was 5–15%.

The following results were obtained:

TABLE 1

| Compression Layer (g/m$^2$) | Compressibility (MPa) | Spots/cm$^2$ |
|---|---|---|
| Controls | | |
| None - receiving layer only C1 (0) | 450 | 92 |
| Polycarbonate layer C2 (5.4) | 380 | 82 |
| None - support only C3 (0) | 500 | ** |
| Invention | | |
| Compound 1 (5.4) | 330 | 44 |
| Compound 2 (5.4) | 300 | 36 |
| Compound 3 (71) | 130 | 18 |
| Compound 4* (11) | 110 | 24 |
| Compound 4* (8) | 110 | 24 |
| Compound 4* (5.4) | 110 | 28 |
| Compound 4* (2.2) | 110 | 43 |
| Compound 4* (1.1) | 110 | 91 |

*The dye image-receiving layer was solution coated for this element. All others were hot-melt laminated.
**Since there was no receiving layer, no image was transferred.

The above data show that compression layers according to the invention which have a compressibility of less than approximately 350 MPa and coated at more than 2 g/m$^2$, were effective in minimizing defects due to casual "dirt".

EXAMPLE 2

Scratch Resistance Tests

Dye-receivers were prepared as in Example 1 using the following compression layer materials (described above) which were coated or hot-melt laminated as in Example 1:

Compound 2—poly-(styrene-co-acrylonitrile) (70–30 wt ratio) coated from 2-butanone solvent.

Compound 4–coated from dichloromethane and trichloromethylene solvent mixture.

Compound 7—a silicon copolymer dissolved in a chlorinated solvent.

Compound 8—a polyurethane resin coated from a dimethylformamide and 2-butanone solvent mixture.

Compound 9—high-density polyethylene (linear, SG=0.95) hot melt extruded onto the support.

Compound 10—poly(p-butyl acrylate-co-acrylic acid) (wt ratio 60:40) coated from butanone, water, and methanol solvent mixture.

Compound 11—Same as Compound 10 but with a wt. ratio of 50:50

Compound 12—Same as Compound 10 but with a wt. ratio of 30:70

Control receivers were prepared similar to those described above but with polymers selected from prior art disclosures and coated from various solvents as follows:

Control 4, C4,—Polybutadiene $$\left(CH_2-CH=CH-CH_2\right)_n$$

Coated from toluene

Control 5, C5,—Elvax 40® (duPont) ethylene-vinyl acetate copolymer (60:40 wt ratio) coated from toluene.

Control 6, C6,—Elvaloy U-741P® (Mitsui Polychemical) ethylene-vinyl acetate copolymer (Example P-1, part F of EP 194,106) coated from 2-butanone and toluene.

Control 7, C7,—Pandex T-5260S-35MT® (Dai-Nippon Ink KK) used in an 8:2 polymer:titanium dioxide ratio (Example P-1, part I of EP 194,106 coated from 2-butanone.

Control 8, C8,—Desmacol 530® (Sumitomo Bayer Urethane) polyurethane resin (Example P-1, part G of EP 194,106) coated from 2-butanone.

Control 9, C9,—low density polyethylene (branched, SG=0.92) hot melt extruded onto the support. Control 10, C10,—similar to Compound 10 but with a 70:30 wt. ratio coated from butanone, water, and methanol.

Tensil moduli were evaluated in the following manner. Each interlayer polymer was compression molded or solvent/cast and dried as a separate film 75 μm to 100 μm thick. Data were obtained as described by the Japanese Industrial Standard Test J1S-K-6301 to obtain Modulus at 100% Elongation and Percent Elongation at Break (at 20 in/min).

The resistance to scratch was also determined. A sample of coated receiver (support, interlayer, and polymeric receiver layer overcoat was rotated on a turntable at 1 rev/32 sec. A spherical glass ball of 0.2 inch diameter under varying loads from 10 g to 100 g was impinged upon the top receiving layer surface. The minimum load that produced visible scratching and surface breaking under 5X visual magnification was determined as MLS (minimum load to scratch in grams). The following results were obtained:

TABLE 2

| Compression Layer ($g/m^2$) | % Elongation at Break | Modulus @ 100% Elongation ($kg/cm^2$ | MLS (g) |
|---|---|---|---|
| Cmpd. 2 (5.4) | 5 | * | >100 |
| Cmpd. 4 (5.4) | 460 | 150 | 15 |
| Cmpd. 7 (8.1) | 230 | 140 | 30 |
| Cmpd. 8 (5.6) | 190 | 320 | >100 |
| Cmpd. 9 (13.7) | 400 | 110 | 40 |
| Cmpd. 10 (8.1) | 220 | 125 | 40 |
| Cmpd. 11 (8.1) | 1 | * | 75 |
| Cmpd. 12 (8.1) | <1 | * | >100 |
| None - receiving layer only C1 (0) | 43 | * | >100 |
| C4 (5.4) | 680 | 90 | <10 |
| C5 (11.0) | 1000 | 12 | <10 |
| C6 (3.3) | 680 | 72 | <10 |
| C7 (8.0) | 850 | 72 | <10 |
| C8 (4.1) | 620 | 45 | <10 |
| C9 (13.0) | >500 | 86 | <10 |
| C10 (8.1) | 570 | 30 | <10 |

*Sample broke before 100% elongation was reached.

The above results indicate that unless the compression layer had less than 500% elongation to break (relatively rigid surface), scratching was observed at less than 10 g load. Many of the compression layer polymers of the invention with low elongation failed to show scratching even at 100 g load. The prior art control polymers of less than 100 $kg/cm^2$ modulus at 100% elongation invariably were prone to scratching at low loads. Compound 10 of the invention, disclosed in EP No. 194,106 as unsatisfactory, performed well in the above tests.

The invention has been described in detail with particular reference to preferred embodiments thereof, but it will be understood that variations and modifications can be effected within the spirit and scope of the invention.

What is claimed is:

1. A dye image-receiving element for thermal dye transfer comprising a plastic film support having thereon, in order, a compression layer and a dye image-receiving layer, said compression layer having a compressibility greater than that of the support or the dye image-receiving layer, said compression layer being coated at a coverage of at least 2.0 $g/m^2$, and said compression layer having an elasticity of less than 500% elongation at break.

2. The element of claim 1 wherein said compression layer has a compression modulus of less than 350 mega Pascals.

3. The element of claim 1 wherein said compression layer is poly(methylmethacrylate).

4. The element of claim 1 wherein said compression layer is poly(styrene-co-acrylonitrile).

5. The element of claim 1 wherein said compression layer is poly(butylene terephthalate) modified with 30 mol % glutaric acid and 45 mol % diethylene glycol.

6. The element of claim 1 wherein said compression layer is the lightly branched ether modified poly(cyclohexylene-cyclohexanedicarboxylate):

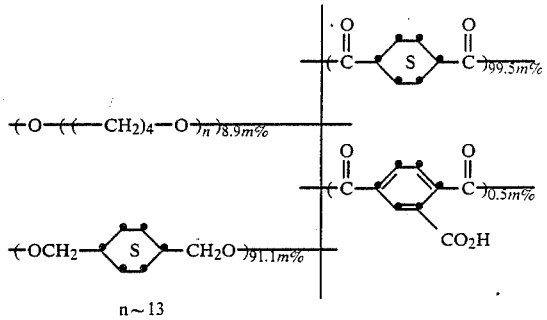

7. The element of claim 1 wherein said compression layer is a polyurethane resin.

8. The element of claim 1 wherein said compression layer is high-density poly(ethylene).

9. The element of claim 1 wherein said compression layer is poly(n-butyl acrylate-co-acrylic-acid).

10. In a process of forming a dye transfer image comprising imagewise-heating a dye-donor element and transferring to dye image to a dye-receiving element to form said dye transfer image, said dye-receiving element comprising a plastic film support having thereon a dye image-receiving layer, the improvement wherein a compression layer is located between said support and said dye image-receiving layer, said compression layer having a compressibility greater than that of said support or said dye image-receiving layer, said compression layer being coated at a coverage of at least 2.0 $g/m^2$, and said compression layer having an elasticity of less than 500% elongation at break.

11. The process of claim 10 wherein said compression layer has a compression modulus of less than 350 mega Pascals.

12. The process of claim 10 wherein the support for the dye-donor element comprises poly(ethylene terephthalate) which is coated with sequential repeating areas of cyan, magenta and yellow dye, and said process steps are sequentially performed for each color to obtain a three-color dye transfer image.

13. In a thermal dye transfer assemblage comprising:

(a) a dye-donor element comprising a support having thereon a dye layer, and (b) a dye-receiving element comprising a plastic film support having thereon a dye image-receiving layer, said dye-receiving element being in a superposed relationship with said dye-donor element so that said dye layer is in contact with said dye image-receiving layer, the improvement wherein a compression layer is located between said support of said dye-receiving element and said dye image-receiving layer, said compression layer having a compressibility greater than that of said support or said dye image-receiving layer, said compression layer being coated at a coverage of at least 2.0 $g/m^2$, and said compression layer having an elasticity of less than 500% elongation at break.

14. The assemblage of claim 13 wherein said compression layer has a compression modulus of less than 350 mega Pascals.

15. The assemblage of claim 13 wherein said compression layer is poly(methylmethacrylate).

16. The assemblage of claim 13 wherein said compression layer is poly(styrene-co-acrylonitrile).

17. The assemblage of claim 13 wherein said compression layer is poly(butylene terephthalate) modified with 30 mol % glutaric acid and 45 mol % diethylene glycol.

18. The assemblage of claim 13 wherein said compression layer is the lightly branched ether modified poly(cyclohexylene-cyclohexanedicarboxylate):

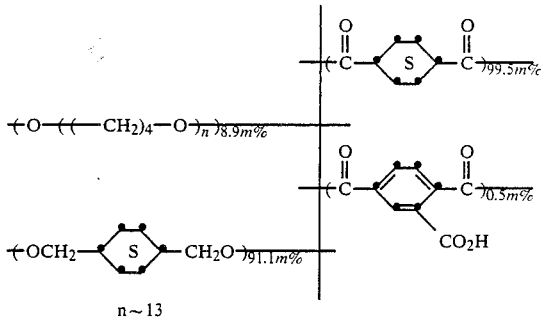

19. The assemblage of claim 13 wherein said compression layer is a polyurethane resin.

20. The assemblage of claim 13 wherein said compression layer is high-density poly(ethylene) or poly(n-butyl acrylate-co-acrylic-acid).

* * * * *